US006397468B2

(12) United States Patent
Popowich

(10) Patent No.: US 6,397,468 B2
(45) Date of Patent: Jun. 4, 2002

(54) PEDAL ARM ASSEMBLY

(75) Inventor: David J. Popowich, Brampton (CA)

(73) Assignee: Ventra Group, Inc., Tottenham (CA)

( * ) Notice: Subject to any disclaimer, the term of this patent is extended or adjusted under 35 U.S.C. 154(b) by 0 days.

(21) Appl. No.: 09/814,928

(22) Filed: Mar. 23, 2001

Related U.S. Application Data

(62) Division of application No. 09/069,960, filed on Apr. 30, 1998, now Pat. No. 6,230,581.
(60) Provisional application No. 60/044,433, filed on Apr. 30, 1997.

(51) Int. Cl.[7] ..... B21D 53/88
(52) U.S. Cl. ..... 29/897.2; 74/512; 74/513; 74/560
(58) Field of Search ..... 29/897.2, 897, 29/505, 514, DIG. 37; 74/512, 513, 560, 516; 72/379.2; 180/90.6

(56) References Cited

U.S. PATENT DOCUMENTS

| | | | | | |
|---|---|---|---|---|---|
| 2,779,209 | A | | 1/1957 | Estes et al. | |
| 3,807,253 | A | | 4/1974 | Belzile et al. | |
| 3,988,945 | A | | 11/1976 | Fasano | |
| 4,300,409 | A | | 11/1981 | Leighton | |
| 4,598,457 | A | * | 7/1986 | Kiwak et al. | 29/505 |
| 5,074,163 | A | | 12/1991 | Baumann | |
| 5,088,343 | A | | 2/1992 | Yokoyama | |
| 5,211,072 | A | * | 5/1993 | Barlas et al. | 74/512 |
| 5,385,068 | A | * | 1/1995 | White et al. | 74/512 |
| 5,419,043 | A | | 5/1995 | Laue | |
| 5,435,205 | A | | 7/1995 | Seksaria et al. | |
| 5,575,181 | A | | 11/1996 | Baumann | |
| 5,685,200 | A | | 11/1997 | Baumann | |
| 5,881,605 | A | | 3/1999 | Doolittle et al. | |

* cited by examiner

*Primary Examiner*—I Cuda Rosenbaum
*Assistant Examiner*—T. Nguyen
(74) *Attorney, Agent, or Firm*—Pillsbury Winthrop LLP

(57) ABSTRACT

An improved vehicle pedal arm assembly made from a one or two-piece stamping of relatively thin gauge material. The preferred pedal arm assembly preferably includes an integral pedal pad. The opposite end of the stamping is formed or spread so that it is equal in width to the arms mating bracket. This arrangement allows for the assembly to pivot without a tubular hub, or spacer.

5 Claims, 7 Drawing Sheets

PEDAL ARM ASSEMBLY

This application is a divisional Application of U.S. patent application Ser. No. 09/069,960, now U.S. Pat. No. 6,230,581, filed Apr. 30, 1998, which claims priority from Provisional Application No. 60/044,433, filed Apr. 30, 1997, the entire disclosure of which are incorporated herein by reference.

BACKGROUND OF THE INVENTION

1. Field of the Invention

The present invention relates to a vehicle pedal arm and, more particularly, to a one or two piece pedal arm assembly, preferably with integral pedal pad.

2. Description of the Related Art

A conventional vehicle pedal arm assembly is illustrated in FIG. 1. Thus, it is typical for a vehicle pedal arm assembly 1 to have a pedal arm 2 formed from a thick steel sheet. A tubular hub 3 is passed through a hole in the pedal arm 2 and is mechanically fastened in place. A pivot pin is passed through the tubular hub so that the arm is free to rotate about the pivot pin. Typically a spacer 4 is inserted to fill any gap between the pivot pin and the tubular hub. A pedal pad 5, to which force is applied in use is welded to the arm 2. Finally, a linkage pin 6 is coupled to the pedal arm 2 and connects the pedal arm 2 to the master cylinder.

In the structure depicted in FIG. 1, the outside diameter of the tubular hub of the spacer is determined by the minimum diameter hole that can be economically manufactured in the pedal arm. This minimum diameter is typically a function of the pedal arm thickness. The use of a large diameter tube forces the use of a larger than necessary pivot pin in terms of its diameter and/or liners or secondary spacers to fill any void between the pin and the tubular hub. The foregoing characteristics result in additional assembly operations, which add to labor and material costs.

SUMMARY OF THE INVENTION

It is an object of the present invention to provide an improved vehicle pedal arm assembly that addresses the deficiencies of the conventional pedal arm described above. Thus it is an object of the invention to provide a structure that allows the tubular hub and/or spacer to be eliminated with a consequent reduction in labor and material costs.

The improved vehicle pedal arm assembly provided in accordance with the invention is formed from a one or two piece stamping of relatively thin gauge material. In accordance with one embodiment of the invention, the pedal pad is integrally formed with the remainder of the assembly. The pedal arm assembly provided in accordance with the invention also allows for a pivot arrangement that does not require a tubular hub, or spacer. More particularly, in the illustrated embodiment, the end of the stamping opposite the pedal pad is formed or spread so that it is equal in transverse width to the arm's mounting bracket. This configuration allows for pivot assembly without a tubular hub or spacer.

Other objects, features and characteristics of the invention as well as the economies of manufacture and advantages of the resultant assembly will become more apparent upon a consideration of the following detailed description with reference to the appended drawings all of which form a part of this disclosure.

DETAILED DESCRIPTION OF TO PRESENTLY PREFERRED EXEMPLARY EMBODIMENT

In accordance with the present invention, a pedal arm assembly 10 is provided that is formed from a stamping of thin gauge steel. In the currently preferred embodiments, the proximal (also referred to as the first end portion) end of the pedal arm assembly 10 is formed or spread as at 12 so that it is equal in transverse width to the arm's mounting bracket. This configuration allows for the assembly to be pivotally mounted without a tubular hub or spacer.

Figure 2:
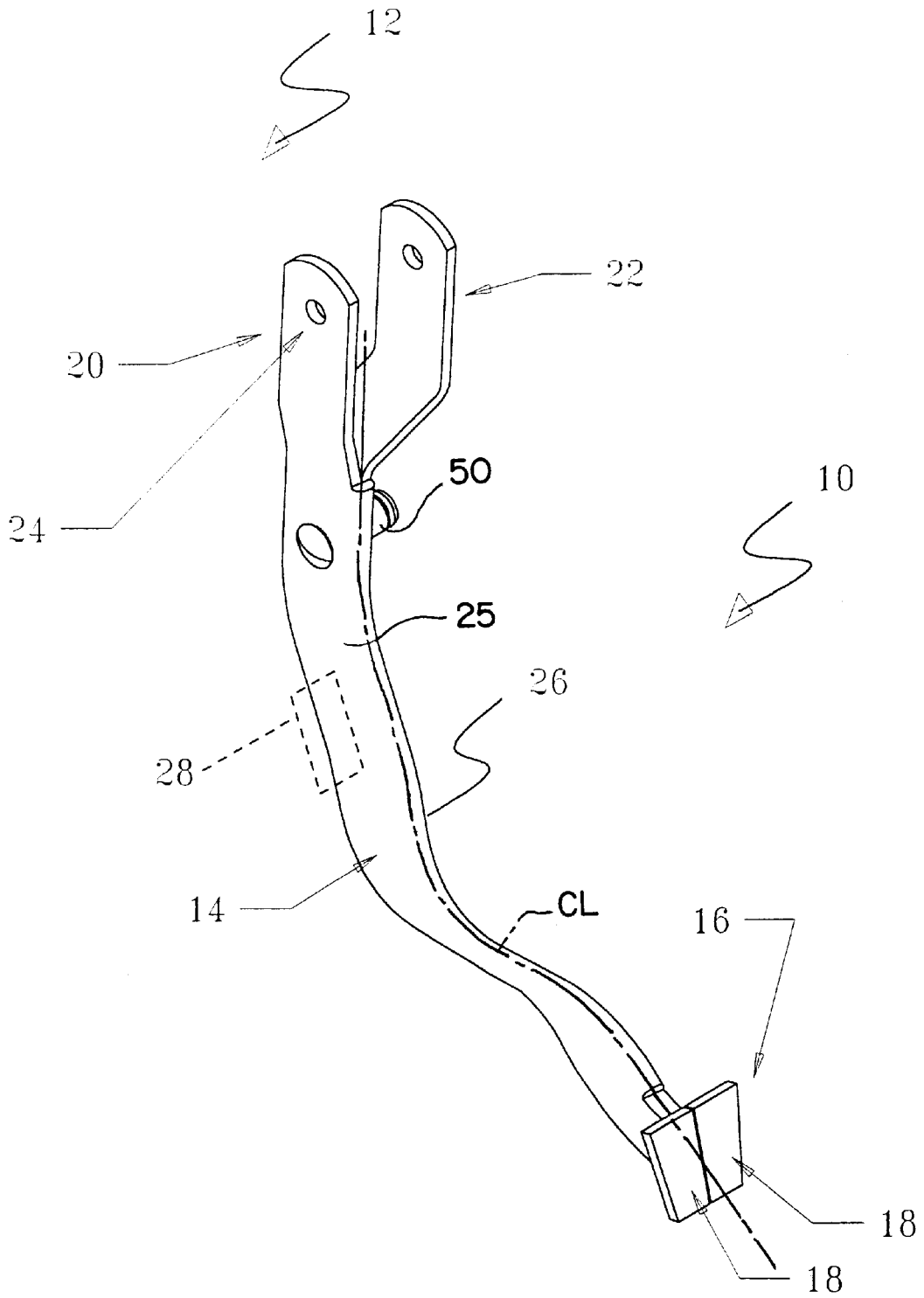
FIG. 2 is a perspective view of a pedal arm assembly provided in accordance with a first embodiment of the invention.

In the embodiment illustrated in FIG. 2, the main body component 14 is formed as a single piece stamping of relatively thin sheet steel. The main body component 14 of the arm is then created by forming the blank 25 through a 180 degree bend about its approximate center (i.e., about its centerline CL) to produce a very tight, U-shaped channel. The one piece stamping in the illustrated embodiment is configured to provide an integral pedal pad 16 by extending two tabs or pedal pad portions 18 from the portion of the bank defining the main body of the arm. Each of the pedal tabs 18 is then formed to be disposed at about 90 degrees with respect to the longitudinal axis of the formed arm section 14 whereby each of the tabs 18 defines one half of the pedal pad plate 16 as illustrated in FIG. 2. As an alternative, a single pedal tab may be used to form the pedal pad plate.

The opposite or proximal end of the main body component defines first and second bracket tabs 20,22 (these tabs 20,22 may also be referred to as first and second spaced apart mounting arms) which may be spread apart as at 12 so that the distance between the two bracket tabs 20,22 is substantially equal to the width of the arm mounting bracket. A hole 24 is defined in each of the bracket tabs for receiving a pivot pin (not shown) for pivotally mounting the pedal arm 10 to the arm's mounting bracket.

As described above, the embodiment illustrated in FIG. 2 the plate is stamped as a single piece and folded so that the fold edge 26 faces the driver. As an alternative, the configuration of the blank can be modified so that the bend is ultimately disposed along the edge facing away from the driver in use. Furthermore, if deemed necessary or desirable, the folded structure of FIG. 2 can be mechanically secured in its folded disposition. Thus, for example, welds, rivets, toggle-locks, and/or locking tab or extrusion features formed integrally with the arm portion(s) may be used to secure the structure in its folded disposition. Such a mechanical fastener or fastening feature is schematically illustrated at 28.

Figure 1:
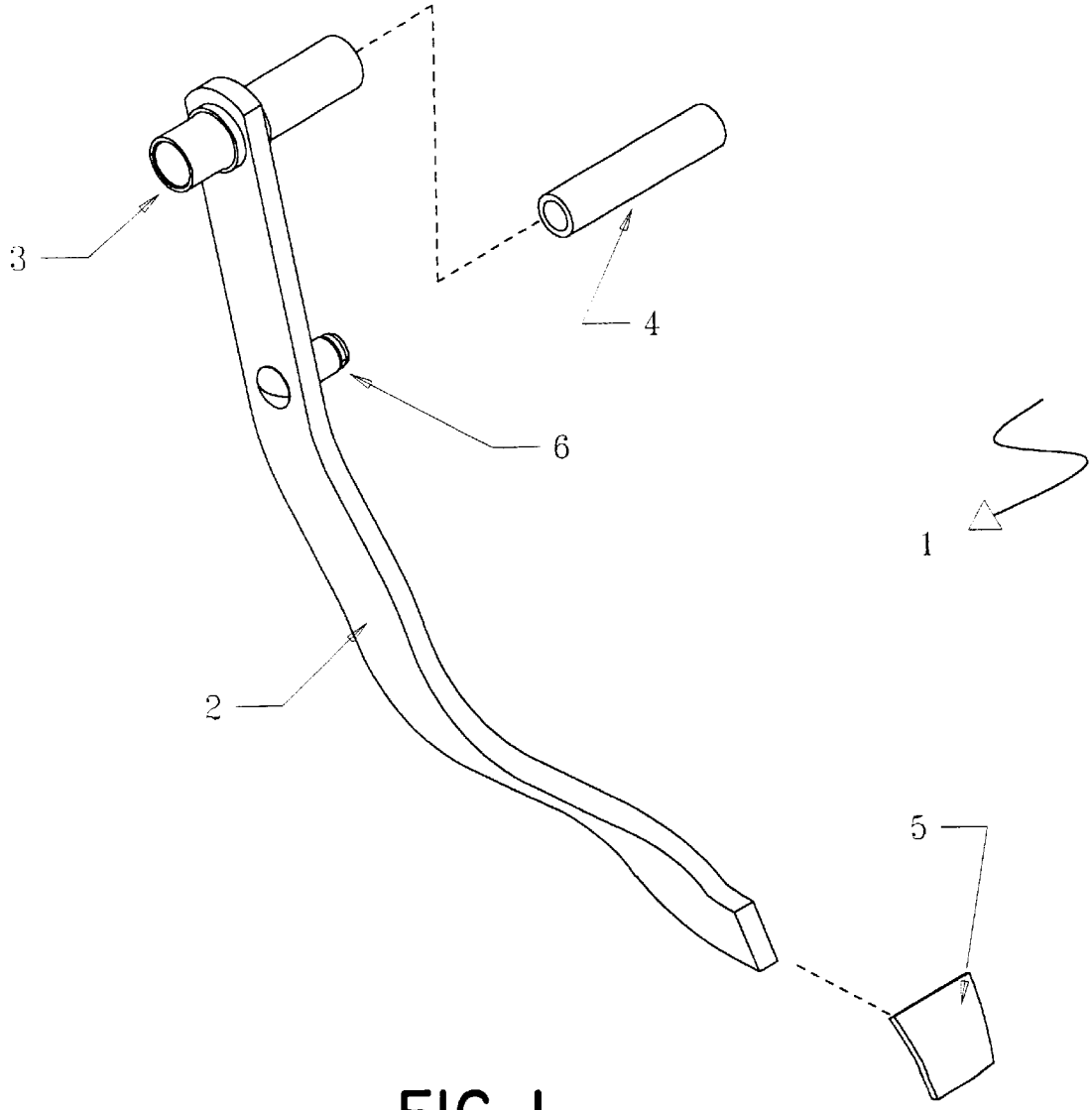
FIG. 1 (PRIOR ART)
FIG. 1 is a partly exploded perspective view of a conventional pedal arm assembly.
Figure 3:
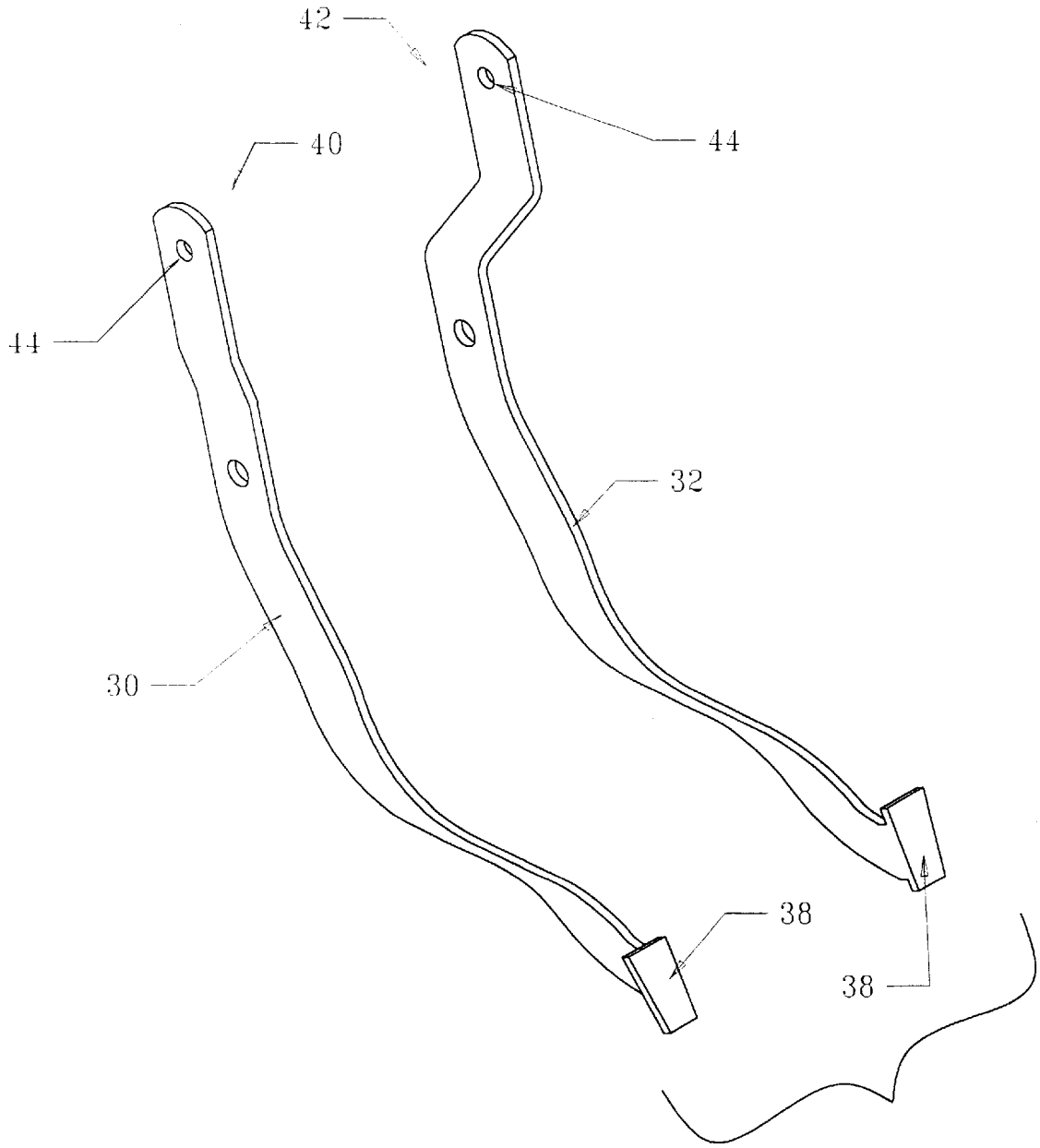
FIG. 3 is an exploded perspective view of a second embodiment of a pedal arm assembly provided in accordance with the present invention.
Figure 4:
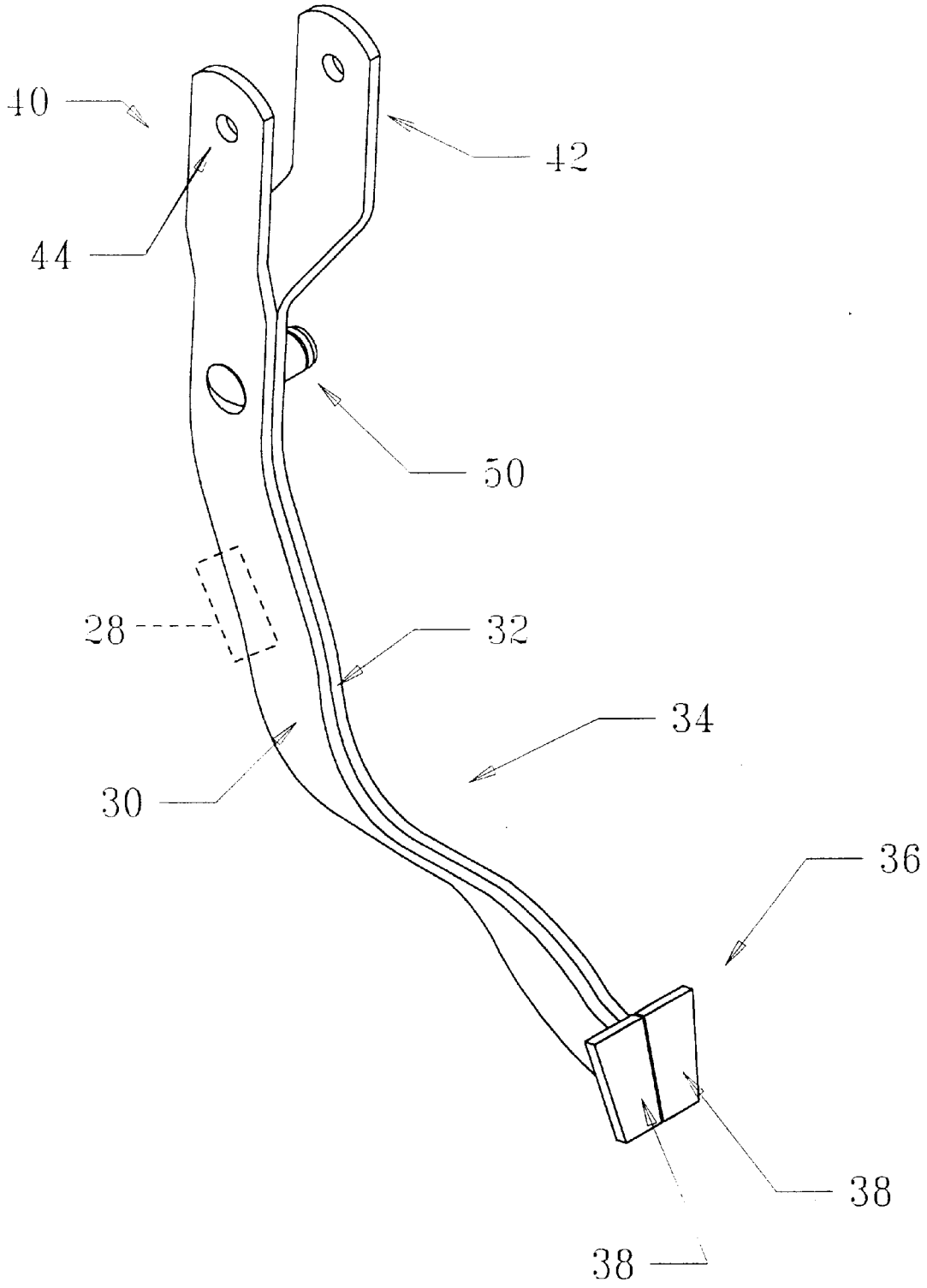
FIG. 4 is a perspective view of the embodiment of FIG. 3 in its assembled disposition.
Figure 5:
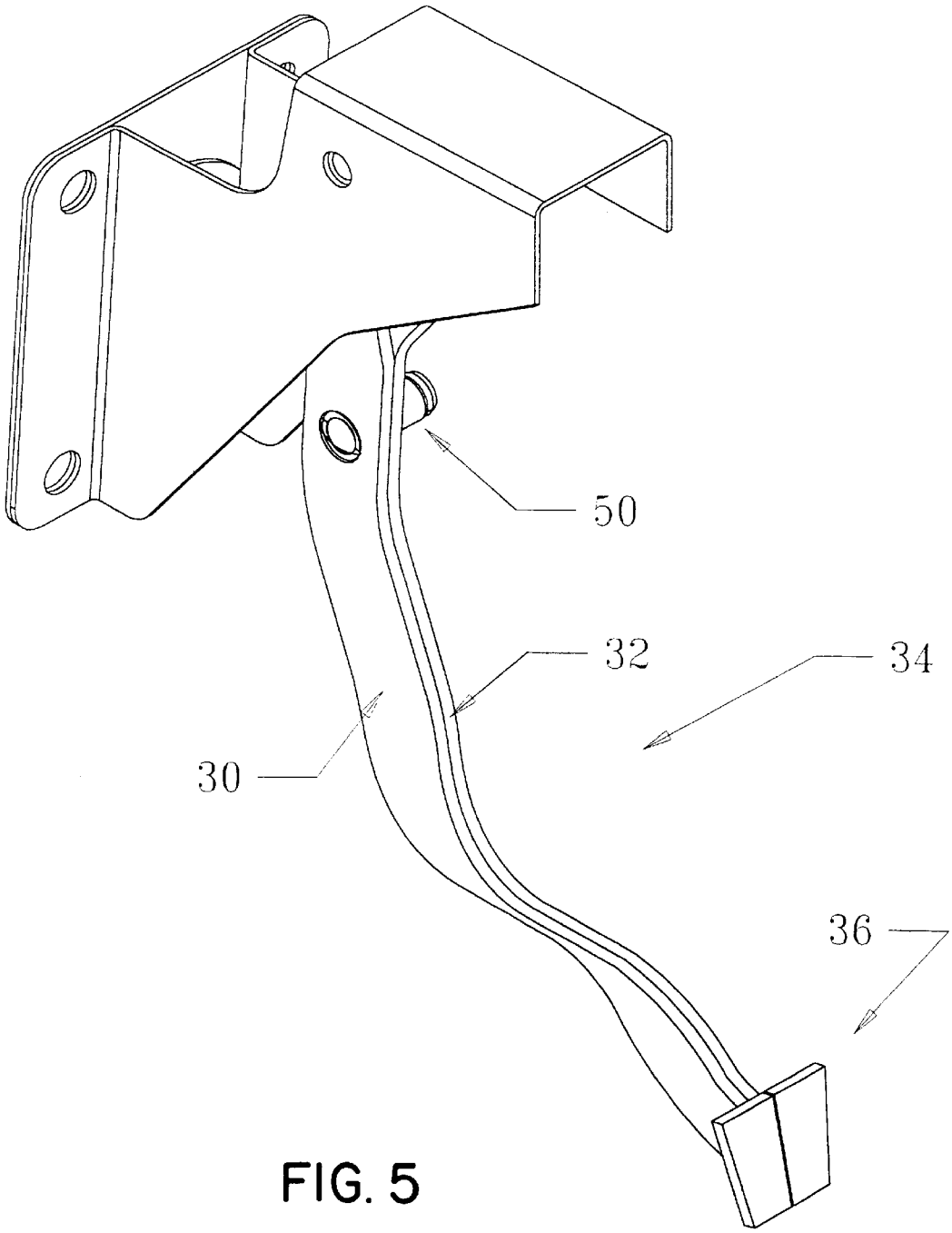
FIG. 5 is a perspective view of the pedal arm of FIG. 3 pivotally mounted to a bracket of an associated vehicle.

As an alternative to forming the main body component as a single or one piece blank, the objects of the present invention may be realized by forming the main body component from two arm portions or components 30,32 each of which is individually stamped from a thin sheet steel. This embodiment of the invention is illustrated by way of example in FIGS. 3–5. The individually formed components are mechanically fastened, as schematically illustrated at 28 in FIG. 4, to form a main body component similar in configuration to the one-piece embodiment of FIG. 2. One skilled in this art will appreciate that there are several possible methods by which the two arm components may be mechanically fastened together. Exemplary mechanical fastening methods include welds, rivets, togglelocks, and/or locking tab or extrusion features formed integrally with one, the other or both of the arm portions and folded or formed to secure the components in their disposition shown in FIG. 4. In addition or in the alternative, as illustrated in FIG. 4, the components may be fastened with the linkage pin 50 to form a mechanically riveted joint between the two components. Using the existing linkage pin provides for a mechanical coupling without the purchase of additional parts or additional labor costs. As with the prior art construction illustrated in FIG. 1, the linkage pin 50 functions as a brake system connecting structure that connects to the vehicle braking system's actuating device, such as, for example, a master brake cylinder. As a result, pivotal movement of the pedal arm assembly causes the linkage pin 50 to operate the vehicle braking system's actuating device.

As with the embodiment of FIG. 2, one, the other or both of the components defining the main body of the pivot arm includes a pedal pad portion or tab 38 at the distal end (also referred to as the second end portion) thereof. The pedal tab 38 is formed or folded to extend at 90 degrees with respect to the longitudinal axis of the main body 34. In the illustrated embodiment each of the arm components 30,32 has a pedal tab 38, each of which is formed to extend at 90 degrees thereby to form the pedal pad structure 36.

The proximal end of each arm component defines a bracket tab 40,42 (as with tabs 20,22, these tabs 40,42 may also be referred to as first and second spaced apart mounting arms). The proximal bracket tabs 40,42 are spread apart so that the distance between the two tab ends is, for example, equal to the width of the mounting bracket for assembly thereto. As is apparent, the spread bracket tabs eliminates the need for a tubular hub. Again, the use of the thinner steel sheet allows for the economical manufacture of a small hole 44, which allows for the use of a smaller diameter pivot pin and eliminates the need for any spacers.

Figure 6:
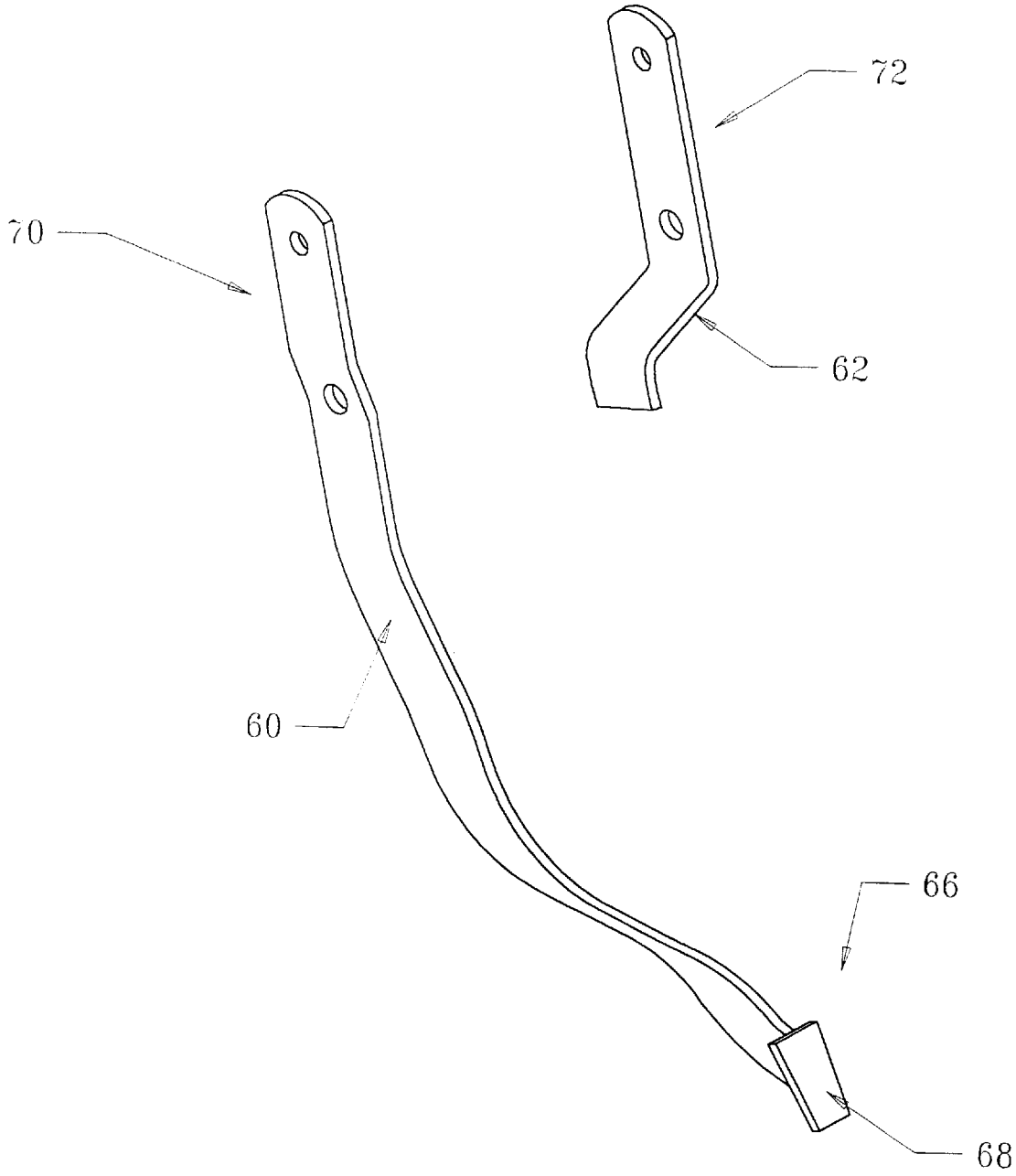
FIG. 6 is an exploded perspective view of a third embodiment of a pedal arm assembly provided in accordance with the present invention.
Figure 7:
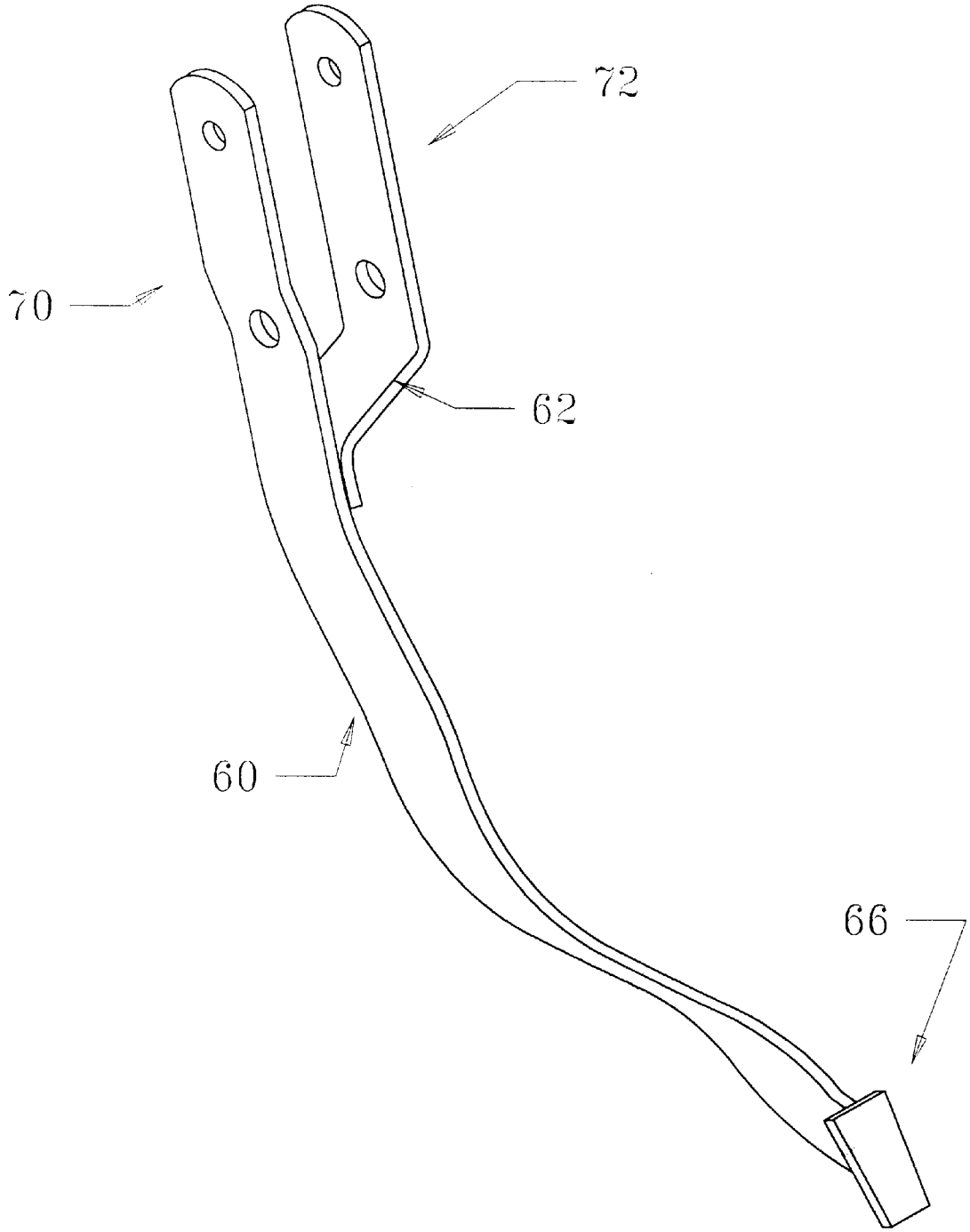
FIG. 7 is a perspective view of the embodiment of FIG. 6 in its assembled disposition.

Yet a further alternative embodiment of the invention is illustrated in FIGS. 6 and 7. In this embodiment, one of the arm portions is an arm component 60 having a configuration similar to arm component 30 of the embodiment of FIGS. 3–5. The other arm portion is a truncated arm component 62 that mechanically secured to arm component 60 in any suitable manner such as by a weld or rivet. Note that in the illustrated structure the bracket tabs 70,72 (as with tabs 20,22 and 40,42, these tabs 70,72 may be referred to as first and second spaced apart mounting arms) comprise a longer portion of the arm components than in the prior embodiments; however, the bracket tabs could alternatively be configured as shown in FIGS. 1–5. Furthermore, in this embodiment, because only one of the arm components extends to the distal end of the main body of the pedal arm assembly, only a single pedal pad tab or portion 68 is provided to define the pedal pad 66. As with the first and second embodiments, this embodiment allows for elimination of the tubular hub and spacer or liner and con provide an integral pedal plate. As will be appreciated, the pedal arm configuration of FIG. 7 could alternatively be formed from a one-piece stamping.

As is apparent from the foregoing, the present invention provides arm portions for a pedal arm assembly that may be more easily and economically manufactured on traditional forming equipment due to the reduction in gauge thickness. The present invention also allows the pedal pad to be integrally provided which eliminates the need for a separate pedal pad tool. Providing an integral pedal pad also eliminates the need for a separate manufacturing operation to form the pedal pad and to attach the pedal pad to the pedal arm.

Moreover, because the pedal arm provided in accordance with the present invention can receive a smaller pivot pin in terms of diameter, it reduces the cost of the assembled part and the weight of the assembly. A reduced pivot pin size also reduces the cost of the associated parts such as the pivot pin bushings because of their reduced size. As is also apparent from the foregoing, the pedal arm assembly provided in accordance with the invention eliminates the need for a tubular hub and the need for any secondary spacers or lining between such a tubular hub and pivot pin. This also reduces the total part cost as well as the need for sub-assembly procedures.

While the invention has been described with reference to the presently preferred, exemplary embodiments it is to be understood that the invention is not limited to the illustrated embodiments but is intended to cover all such structures falling within the spirit and scope of the appended claims.

What is claimed is:

1. A method of making a pedal arm assembly for installation on a pivot pin located in a motor vehicle and operative connection to a brake system actuating device, said method comprising:

providing a relatively thin gauge material;

stamping said material so as to define a first mounting arm and a second mounting arm;

forming a pivot pin receiving aperture in each of said mounting arms;

disposing said mounting arms in side-by-side and spaced apart relation to define a main body component having first and second opposing end portions with said mounting arms on the first end portion thereof;

providing a brake system connecting structure intermediate the first and second end portions of said main body component, thus enabling said pedal arm assembly to be installed by pivotally mounting said pivot pin receiving apertures to the pivot pin located in the motor vehicle and operatively connecting said connecting structure to the brake system actuating device so that pivotal movement of said main body component about the pivot pin apertures operates the brake system actuating device and providing a pedal pad at the second end portion of the main body component, said brake pedal being configured to allow a vehicle operator to apply foot pressure thereto when said pedal arm assembly is installed as aforesaid to affect the pivotal movement of said main body component and operation of the brake system actuating device, and providing a pedal pad at the second end portion of the main body component, said pedal pad being configured to allow a vehicle operator to apply foot pressure thereto when said pedal arm assembly is installed as aforesaid to affect the pivotal movement of said main body component and operation of the brake system actuating device.

2. A method as in claim 1, wherein said first and second mounting arms are integrally formed as a one piece blank, and wherein said one piece blank is folded about a center line thereof so as to define said main body component.

3. A method as in claim 1, wherein said first and second mounting arms are independently formed, said first and second mounting arms are mechanically secured together to define said main body component.

4. A method as to claim 1, further comprising mechanically securing said first and second mounting arms in said side-by-side relation.

5. A method as in claim 4, wherein said step of mechanically securing comprises securing by at least one of a weld, a rivet, a toggle-lock, and an integral locking tab.

* * * * *